US012209472B2

(12) United States Patent
Pallin et al.

(10) Patent No.: US 12,209,472 B2
(45) Date of Patent: Jan. 28, 2025

(54) DOWNHOLE STUCK OBJECT REMOVAL TOOL

(71) Applicant: SAPEG AS, Tiller (NO)

(72) Inventors: Jan Egil Pallin, Heimdal (NO); Geir Olav Ånesbug, Meldal (NO)

(73) Assignee: SAPEG AS, Tiller (NO)

( * ) Notice: Subject to any disclaimer, the term of this patent is extended or adjusted under 35 U.S.C. 154(b) by 10 days.

(21) Appl. No.: 15/845,468

(22) Filed: Dec. 18, 2017

(65) Prior Publication Data

US 2018/0179845 A1 Jun. 28, 2018

(30) Foreign Application Priority Data

Dec. 23, 2016 (NO) ..... 20162055

(51) Int. Cl.
*E21B 31/107* (2006.01)
*E21B 29/00* (2006.01)

(52) U.S. Cl.
CPC ..... *E21B 31/107* (2013.01); *E21B 29/00* (2013.01)

(58) Field of Classification Search
CPC ..... E21B 31/107; E21B 10/32; E21B 10/325; E21B 29/00; E21B 29/002; B23B 51/0406; B23B 51/0473; B23B 51/0426
See application file for complete search history.

(56) References Cited

U.S. PATENT DOCUMENTS 6,155,360 A * 12/2000 McLeod ..... E21B 10/66 175/258
6,964,303 B2 * 11/2005 Mazorow ..... E21B 7/061 166/298
8,858,133 B2 * 10/2014 Beynon ..... B23B 51/0426 408/1 R
2008/0260481 A1 * 10/2008 Omi ..... B23B 31/1071 408/226
2009/0022560 A1 * 1/2009 Liemke ..... B23B 51/0406 408/144
2014/0060801 A1 3/2014 Coleman et al.
2015/0071721 A1 * 3/2015 Piper ..... B23B 51/0426 408/204
2015/0343540 A1 * 12/2015 Hoop ..... B28D 1/041 408/204
2017/0368655 A1 * 12/2017 Bergman ..... B23Q 11/0071
2019/0218875 A1 * 7/2019 Zhang ..... E21B 4/18

FOREIGN PATENT DOCUMENTS

EP 2132403 B1 8/2011
EP 2924230 A1 9/2015
WO WO-2012154283 A1 * 11/2012 ..... B23D 47/12

* cited by examiner

*Primary Examiner* — Theodore N Yao
(74) *Attorney, Agent, or Firm* — Alix, Yale & Ristas, LLP

(57) ABSTRACT

A downhole stuck object removal tool for arrangement to a downhole drive system has a cutting assembly and a drilling assembly arranged with the same longitudinal central axis. The drilling assembly is arranged movable in the longitudinal direction in the cutting assembly, from a retracted position in the cutting assembly to an advanced drilling position extending beyond the length of the cutting assembly.

12 Claims, 5 Drawing Sheets

DOWNHOLE STUCK OBJECT REMOVAL TOOL

BACKGROUND

The present disclosure is related to a downhole stuck object removal tool, and more particularly to a downhole stuck object removal tool arranged for drilling and cutting through a stuck object in a well casing or borehole, and retrieval of the stuck object.

It is a well-known problem that different objects or tools might be stuck in a borehole or well casing of a borehole.

It is known to use dropping of balls in a well casing to fracture a formation to increase hydrocarbon-containing fluid production, and further used to inject fluid into the formation from an injection well. The ball flows down the casing and seats in a ball seat of a sliding sleeve. Several balls with increasing diameter are often used and where the smallest ball is dropped first. After the fracturing or injection process, the balls need to be collected from the well in order to start the production of hydrocarbon-containing fluid from the reservoir or to inject injection fluid at a level below the ball. From time to time these balls are stuck and it is not possible to retrieve them in a simple manner.

Another example of a stuck object or tool in a borehole or well casing is valves. Valves being closed for some time can get stuck due to corrosion or the like, resulting in that the valves cannot be reopened with normally used equipment. In such situations, reboring of the stuck valve is usually the only solution.

When reboring stuck objects one are facing different challenges, such as that the drill bit tends to slide on the abutting surface, especially if the valve is a ball valve. A further challenge is to use a proper landing tool which ensures that the drilling is performed correctly. Another challenge is to drill with the appropriate pressure/weight and centralization of the drilling/cutting elements. If too much weight is applied the cutting/drilling elements the cutting/drilling structure can break off, which will result in that the cutting/drilling process will have to be stopped, the tool retrieved from the casing and the operation started again. Too little weight applied to the cutting/drilling elements will however slow the cutting/drilling penetration rate. When drilling in very hard materials control on the weight/pushing force applied during cutting/drilling is further required.

As mentioned above, when cutting or drilling rounded or curved shapes, such as ball valves or curved flappers, it will be required to centralize the cutting/drilling element as it is to penetrate the rounded or curved surface, as centralizing would be an advantage to keeping the cutting/drilling elements on track and finishing the cutting/drilling operation sooner.

Further, as time is of essence, especially at situations where the stuck object is far downhole, it is desirable that one is able to perform the operation in one run.

From EP2924230 it is known a downhole system for collecting an object in a well casing comprising a plurality of tubular sections, and a restriction, capable of seating the object in the restriction, and a collection tool comprising a tool section adapted to provide an axial force in a first direction, and a collecting section connected to the tool section and comprising an abutment edge forming a leading edge when the tool section moves the collection section in the first direction for abutting the object. The solution is a plain retrieval tool and contains no means for cutting or drilling and is thus not capable of retrieving a stuck object.

In EP2132403, it is described a drilling head for reboring a stuck valve or drilling into the formation downhole and a drilling tool comprising the drilling head and a driving unit. The drilling head comprises a hole saw beside a drill bit for cutting out a piece from the stuck valve.

One disadvantage of the solution of EP2132403 is, among others, that the drill bit is firmly fixed to the hole saw, and where it is the drill bit which first comes into engagement with the valve. Accordingly, there is no centralization as described above. Further, in EP2132403 both the hole saw and the drill bit are operated with the same speed and weight or pushing force so that the longitudinal displacement of the hole saw and drill bit towards the valve remains constant during the drilling process, and will thus suffer from the above mentioned problems with drilling or cutting with appropriate weight and/or pushing force and centralization issues. By drilling or cutting with the same weight/pushing force and speed on the drill bit and hole saw at an initial stage could result in damage of the drill bit or hole saw as well as there is a risk for the drill bit to slide on curved surfaces.

A further disadvantage of EP2132403 is that it will, due to that the hole saw at the cutting edge is provided with cutting edges inclining inwards to the longitudinal axis of the hole saw not be able to cut the entire width of the casing/valve, resulting in a narrower passage than the remaining casing where balls and other objects being below can get stuck. Further, a narrower passage will also limit the fluid flow and could in addition result in turbulence in the flow.

From US2014060801 it is known a preload and centralizing device for milling subterranean barrier valves arranged for controlling the weight that can be set down on the tool while the tool is operating by that a shroud is secured to the string that supports the tool with interior modular biasing components that for run in extend the tool past the shroud. Upon encountering a support for the tool, further set down weight compresses the biasing components for a predetermined stroke length delineated by the shroud landing on a support. If the tool is a mill, its operation takes place under the biasing force as the mill advances into the piece being cut or milled under a predetermined pressure. When the mill reaches full extension form of the shroud, the process can be repeated until the milling is complete. A disadvantage with this solution is that it requires several drilling runs and it will still not provide full opening through a valve. As it will be the drill bit which first hits a stuck object proper centralization is not achieved. A further disadvantage with this solution is that it is not capable of retrieving components from the object to be removed, but one will get a lot of metal shavings which will be mixed with fluid in the casing.

Accordingly, there is a need for a downhole stuck object removal tool which is arranged for being operated with different weight and/or pushing force in different phases of a cutting and/or drilling operation. It is further a need for a downhole stuck object removal tool arranged for both drilling and cutting, as well as retrieval of a stuck object in one run.

SUMMARY

The disclosure provides a downhole stuck object removal tool which partly or entirely solve the disadvantages and lacks of prior art.

Also provided is a downhole stuck object removal tool arranged for both drilling and cutting of the stuck object, as well retrieval of the stuck object in one run.

Also provided is a downhole stuck object removal tool providing increased control of the drilling and cutting operation.

Also provided is a downhole stuck object removal tool where cutting assembly and drilling assembly can be operated both independently and together.

Also provided is a downhole stuck object removal tool enabling different weight/pushing force of cutting assembly and drilling assembly.

Also provided is a downhole stuck object removal tool capable of opening the entire width of the casing, borehole or similar.

Also provided is a downhole stuck object removal tool handling stuck objects of different shapes and surface.

Also provided is a downhole stuck object removal tool capable of retrieving approximately the entire stuck object.

Also provided is a downhole stuck object removal tool which provides engagement with the stuck object before drilling is performed.

Further characteristics of the disclosed embodiments will appear from consideration of the following description, claims and attached drawings.

The disclosure provides a downhole stuck object removal tool for arrangement to a downhole drive system of known prior art, but is especially suited for arrangement to a downhole propulsion machine, often referred to as "tractors", which have been used for several years to facilitate the conveyance of wireline assemblies into a well bore, and most conventional tractors can be grouped powered-wheel and crawlers. The tractors are arranged for engagement with inner walls of a casing, string or open hole, to power the tractor and any portions of pipe or tubing or wireline tools connected thereto. In the disclosed embodiments, reference is made to such tractors as an example of a downhole drive system for arrangement and powering of a downhole stuck object removal tool, but it is obvious that also other known downhole drive systems, which a skilled person will be familiar with, can be used.

The downhole stuck object removal tool according to the disclosure comprises a cutting assembly and a drilling assembly having coincident longitudinal center axes, where the drilling assembly is arranged movable in longitudinal direction in the cutting assembly, from a retracted position in the cutting assembly to an advanced drilling position extending beyond the length of the cutting assembly. Accordingly, the drilling assembly has its extension along the longitudinal center axis of the cutting assembly.

The downhole stuck object removal tool according to the disclosure further comprises a pretension assembly which is arranged in connection with the drilling assembly providing a retaining force/pretension force for the drilling assembly in the longitudinal direction of the cutting assembly. Accordingly, in the disclosed embodiments, it is required that a certain weight/pushing force is applied to the drilling assembly before it protrudes from the cutting assembly.

According to the disclosure the cutting assembly is provided with at least two cutting faces with different exterior diameter displaced in longitudinal direction of the cutting assembly, accordingly providing a two-stage cutting assembly when the downhole stuck object tool is moved in a longitudinal direction, wherein the cutting face with smallest exterior diameter is arranged at the bottom of the cutting assembly. A cutting assembly according an embodiment is formed by a mainly tubular body which at a lower part thereof is provided with an outer and inner hole saw with different inner and exterior diameter. The hole saws can be arranged to each other to form an assembly which can be arranged to the tubular body by means of suitable fastening means, such as welding or screws, where the inner hole saw is arranged at lower end of the outer hole saw. In a preferred embodiment the outer hole saw exhibits an inner diameter adapted to the exterior diameter of the tubular body, and an exterior diameter adapted to an inner diameter of a casing, string or borehole which the downhole stuck object tool is to be used in. The inner hole saw exhibits an exterior diameter adapted the inner diameter of the outer hole saw. The outer and inner hole saw provides a hole saw configuration defining even feeding at operation. The hole saw configuration further results in that the outer hole saw support the inner hole saw against cutting deviation and vice versa, i.e. that the inner hole saw is support for the outer hole saw when this is in engagement with the stuck object.

According to a further embodiment also the inner diameter of the lower hole saw corresponds to the inner diameter of the tubular body.

Accordingly, the inner hole saw will cut through a stuck object, while the outer hole saw will enlarge this hole to a full opening corresponding to the inner diameter of the casing, string or borehole.

In another embodiment the tubular body it is at an upper part thereof provided with through holes in a circumferential direction thereof. The through holes will allow fluid flow, as well as metal shavings/particles to pass, through the through holes in or out of the tubular body.

In another embodiment, the tubular body is at an upper interior part thereof provided with magnet assemblies in a circumferential direction thereof for collection of metal shavings/particles from drilling and cutting of a stuck object.

In another embodiment, the inner hole saw is provided with through openings, distributed in a circumferential direction thereof, at an area below the outer hole saw to allow fluid flow, as well as metal shavings/particles to pass, into the tubular body. Metal shavings/particles can then be collected by the magnet assemblies in the tubular body before possibly flowing/passing out of the tubular body through the holes in upper part thereof.

In another embodiment, the outer hole saw is provided with grooves extending at exterior surface thereof, extending from lower end thereof to upper end thereof to allow flow of fluid and/or metal shavings/particles to pass past the outer hole saw.

In another embodiment, the outer and inner hole saw are provided with grooves extending at exterior surface thereof, extending from lower end thereof to upper end thereof to allow flow of fluid and/or metal shavings/particles to pass past the hole saws.

In another embodiment, the mentioned grooves preferably extend in a curved path from the lower end to the upper end of the hole saw(s).

In another embodiment, the grooves of the outer and inner hole saw correspond with each other.

In another embodiment, the grooves of the inner hole saw and/or outer hole saw preferably correspond/coincide with the above mentioned through holes in the inner hole saw.

According to a further embodiment, the cutting edges of the outer and inner hole saws are provided with wolfram carbide, polycrystalline diamond or Polycrystalline cubic boron nitride cutting segments.

According to a further embodiment, the inner hole saw, at lower end thereof, is provided with openings towards the cutting surface thereof for allowing metal particles and/or metal shavings from the cut object to enter the inner hole saw/cutting assembly.

According to a further embodiment, the cutting segments of the inner and/or outer hole saw are arranged such that they exhibit a larger exterior diameter than the exterior diameter of the inner/outer hole saw, providing a flow path for fluid and/or metal shavings/particles to pass along the extension of the inner/outer hole saw.

A typical drilling assembly is formed by a drill bit arranged to a stem.

According to a further embodiment, the drill bit is step drill bit.

The downhole stuck object removal tool further includes a spline drive assembly arranged for rotation of both the cutting assembly and the drilling assembly. The spline drive assembly comprises a spline shaft which is connected to an adapter at upper end for connection to a downhole drive system, while at the other end is arranged for connection of the drilling assembly. The spline shaft is at upper part provided with a section with ridges, while at lower part is without ridges and exhibits a smaller diameter than the section with ridges. The spline shaft extends from the adapter and through the cutting assembly, where a spline bushing with recess is arranged at upper part of the cutting assembly with the recesses of the spline bushing in engagement with the ridges of the spline shaft.

Accordingly, by rotation of the spline shaft both the drilling assembly and cutting assembly will rotate.

According to a further embodiment the pretension assembly is arranged to the spine shaft, i.e. surrounding the spline shaft, between upper end of the cutting assembly and the adapter. It is further arranged a locking nut to the spline shaft in the tubular body, below the spline bushing holding the parts together. Accordingly, the pretension assembly compression will limit the movement in longitudinal direction of the spline shaft/drilling assembly in one direction and the locking nut will limit the movement in longitudinal direction of the spline shaft/drilling assembly in the other direction.

According to a further embodiment the downhole stuck object removal tool comprises a retention assembly arranged in upper part of the cutting assembly, the retention assembly being arranged for engagement with the spline shaft of the spline drive assembly to provide a retaining force for the drilling assembly in longitudinal direction of the downhole stuck object tool which requires a certain weight/pushing force to be applied before the spline shaft and thus drilling assembly can be moved in longitudinal direction of the downhole stuck object tool.

According to a further embodiment the downhole stuck object removal tool comprises a retaining device arranged between the lower end of the spline shaft and the drilling assembly/drill bit. According to an embodiment of the retaining device the retaining device includes a mainly tubular body provided with at least two wings cut out in circumferential direction thereof and slightly projected/inclined from the circumference of the tubular body, which wings have progressive spring properties, i.e. arranged to the tubular body in a resilient manner, such that they can be pressed towards the central axis of the tubular body when traveling through a hole drilled by the drilling assembly, and will return to the projected/inclined position when the retaining device has passed through the hole.

Accordingly, disclosed herein is a downhole stuck object tool where the drilling assembly is retained in the cutting assembly by the pretension assembly and optionally the retention assembly. By this is achieved that the cutting assembly is allowed to land on the stuck object and come into engagement with the stuck object with the drilling assembly retained in the cutting assembly. The cutting assembly is then able to cut a guide slot into the stuck object for safe engagement and centralization by applying a controlled/defined weight/pushing force to the upper side of the downhole stuck object tool being lower than the pretension force of the pretension assembly and optionally the retention force of the retention assembly. By applying a controlled weight/pushing force being higher than the pretension force of the pretension assembly and optionally retention force of the retention assembly, the drilling assembly will protrude from the retracted position in the cutting assembly and to an advanced drilling position extending beyond the length of the cutting assembly and start drilling into an upper surface of the stuck object. Accordingly, by controlling rotational speed and weight/pushing force applied to upper end of the downhole stuck object tool a controlled cutting and drilling operation can be performed.

Further, by the downhole stuck object tool disclosed herein the cutting assembly and drilling assembly can be operated both independently and together.

By the downhole stuck object tool disclosed herein is further achieved a solution where the cutting assembly and drilling assembly can be operated with different weight/pushing force in different phases of cutting and drilling of a stuck object if necessary or desired.

By the downhole stuck object tool disclosed herein it is provided a solution where a full opening through a stuck object is achieved by one run due to the two-stage hole saw.

Further, the downhole stuck object removal tool disclosed herein approximately all drilled and cut parts of the stuck object will be retrieved due to the retaining device, tubular body and magnet assemblies.

By the downhole stuck object tool disclosed herein is further provided a tool which is capable of handling stuck objects with any shape or surfaces.

Further preferable features and advantageous details of the disclosed embodiments will appear from the following example description, claims and attached drawings.

BRIEF DESCRIPTION OF THE DRAWINGS

The present invention will below be further described with references to the attached drawings, where.

DETAILED DESCRIPTION

Figure 1A:
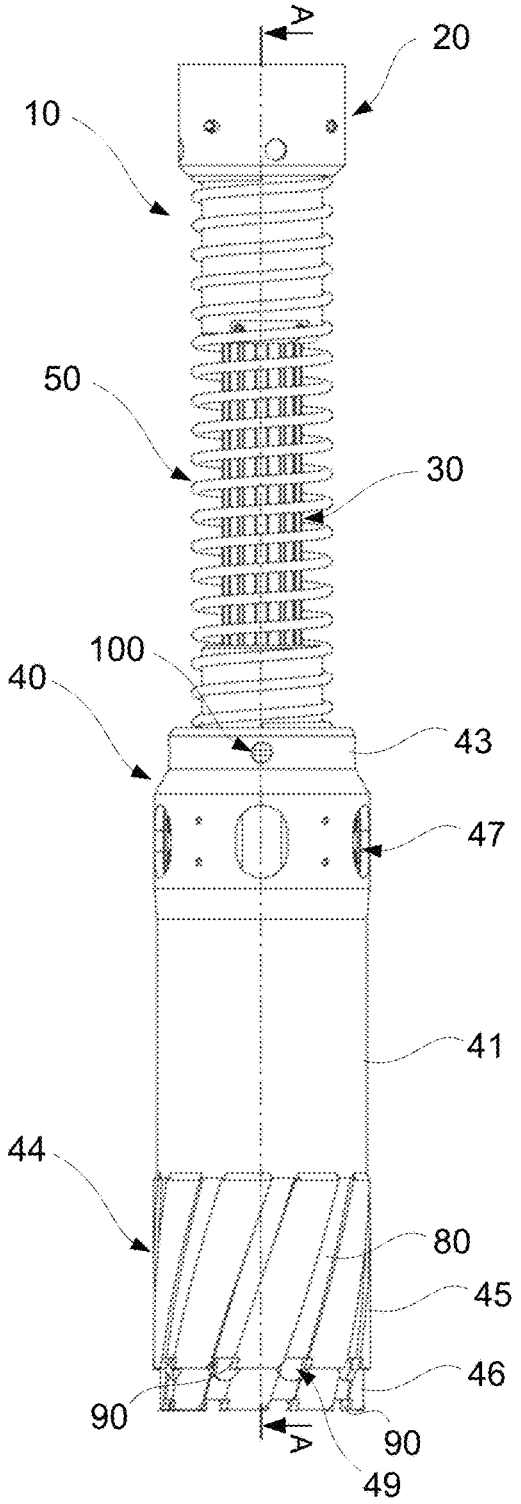
FIGS. 1*a*-1*c* show an embodiment of the disclosed downhole stuck object removal tool.
Figure 1B:
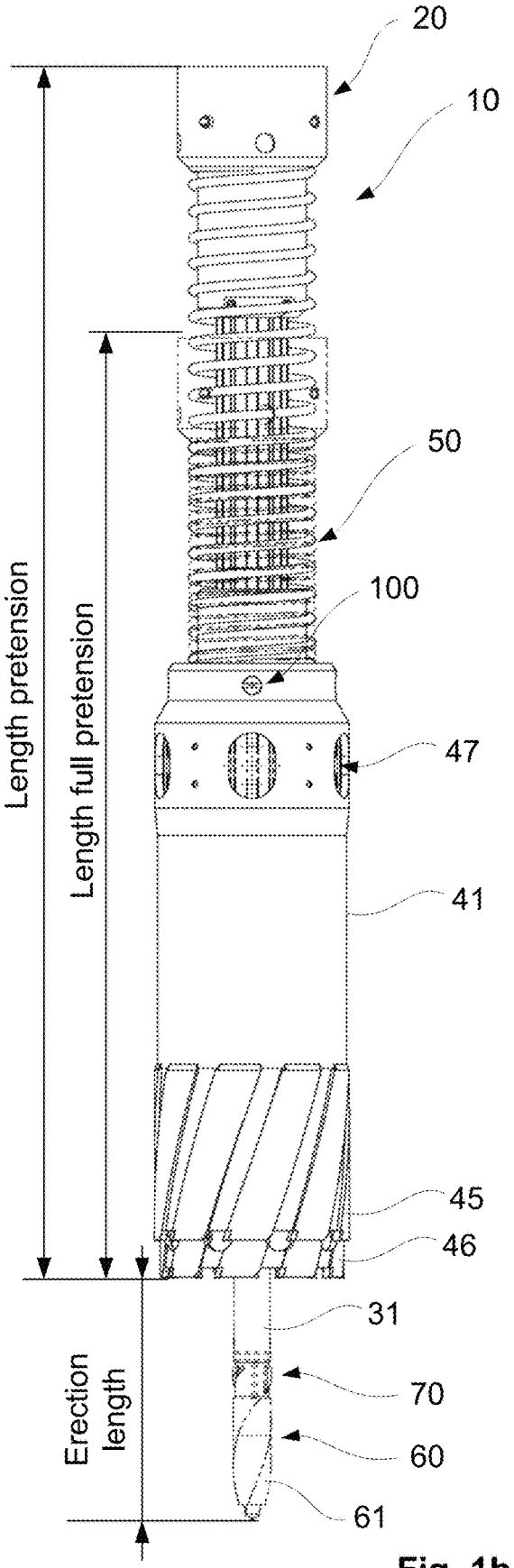
Figure 1C:
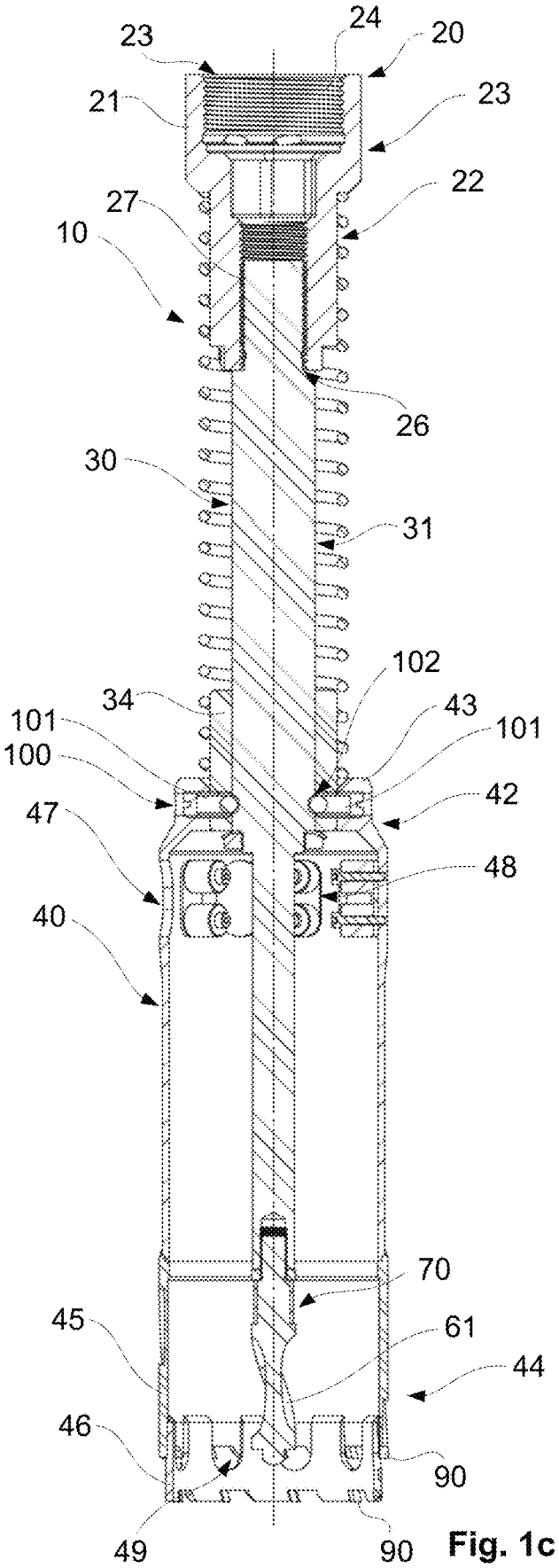

Reference is now made to FIGS. 1*a*-1*c* and 2 showing a downhole stuck object removal tool 10 according to the disclosure. FIG. 1*a* is a principle drawing of the downhole stuck object removal tool 10 with a drilling assembly 60 retracted in a cutting assembly 40, FIG. 1*b* is a principle drawing of the downhole stuck object removal tool 10 with the drilling assembly 60 protruding from the cutting assembly 40, and FIG. 1*c* is a cross-sectional drawing of FIG. 1*a*.

The downhole stuck object removal tool 10 according to the disclosure is formed by an adapter 20, a spline drive assembly 30, a cutting assembly 40, a pretension assembly 50, and a drilling assembly 60.

The adapter 20 is formed by a mainly cylinder-shaped body 21, which exhibits a lower part 22 with shorter diameter than an upper part 23. The upper part is provided with a recess 24 provided with interior threads 25 for connection to a drive shaft (not shown) of a downhole drive system, such as a downhole wireline tractor system or similar, which is well known in prior art.

The lower part 22 of the adapter 20 is provided with a recess 26 provided with interior threads 27 for connection to the spline drive assembly 30.

The spline drive assembly 30 is formed by a spline shaft 31 which at upper part is provided with exterior threads 32 for connection in the threads of the lower part 22 of the adapter 20. The spline 31 is further at upper part thereof provided with a section with ridges 33, while a lower part is without ridges and provided with smaller diameter than the part with the ridges 33. At lower end the spline shaft 31 is provided with a recess (not shown) provided with interior threads (not shown) for connection to the drilling assembly 60. The spline drive assembly 30 further includes a spline bushing 34 adapted for arrangement in the cutting assembly 40, further explained below.

The cutting assembly 40 is formed by a mainly hollow tubular body 41, which at upper end is provided with a constriction 42 ending in an upwards protruding flange 43. The constriction 42 and upwards protruding flange 43 is adapted for accommodating and fixation of the spline bushing 34 at upper part of the tubular body 41. The cutting assembly 40 further includes a double stage hole saw assembly 44 arranged at lower part thereof, the double stage hole saw assembly 44 being formed by an outer 45 and inner 46 hole saw, respectively, exhibiting different inner and exterior diameter, where the inner hole saw 46 is arranged at lower part of the outer hole saw 45 and protruding in longitudinal direction of the hole saw assembly 44 from the outer hole saw 45. The outer hole saw 45 exhibits an inner diameter corresponding to the inner diameter of the tubular body 41 and exhibits an exterior diameter adapted the inner diameter of the casing, string or borehole the downhole stuck object tool 10 is to be used in. The inner hole saw 46 exhibits an exterior diameter corresponding to the inner diameter of the outer hole saw 45.

Figure 3A:
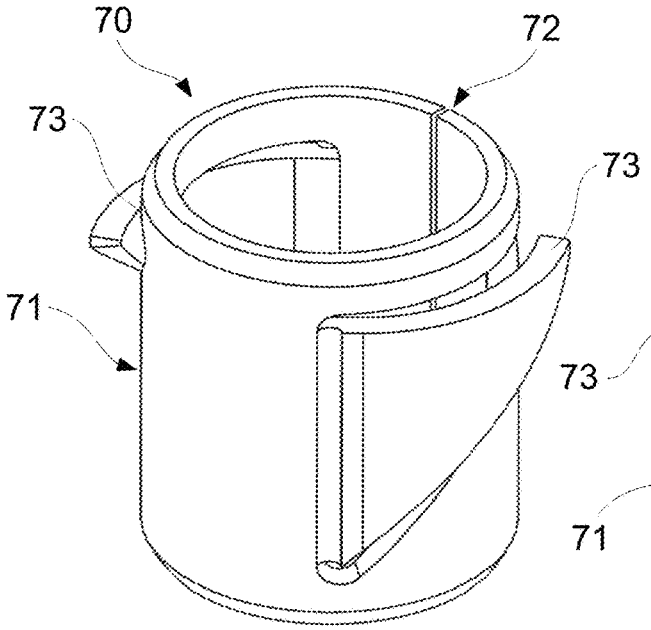
FIGS. 3*a*-3*c* show an embodiment of a retaining device.
Figure 3B:
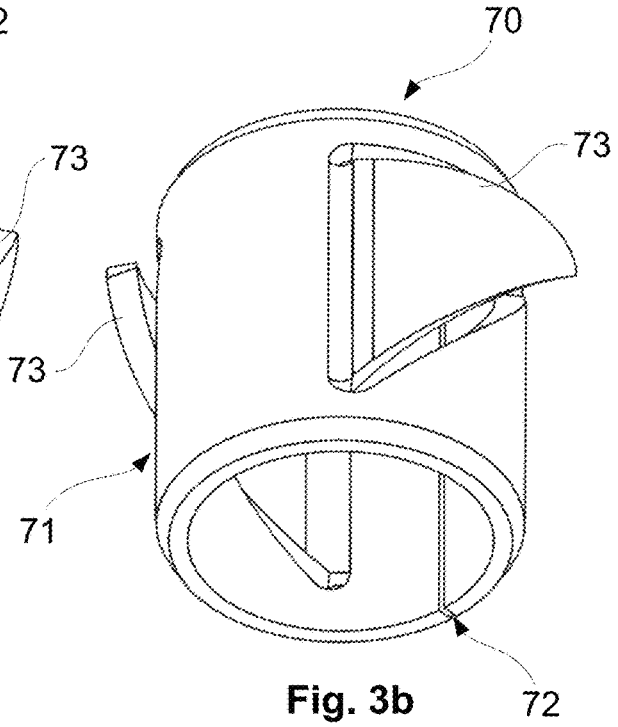

The drilling assembly 60 is formed by a drill bit 61 arranged to a stem 62 which at the other end is provided with a threaded end 63 arranged for insertion into the lower end of the spline shaft 31 and into engagement with the corresponding interior threads at lower end thereof. The stem 62 exhibits a length in the longitudinal direction adapted for arrangement of a retaining device 70. According to an embodiment, as shown in FIGS. 3*a-b*, the retaining device 70 is formed by a mainly tubular body 71 which exhibits an opening 72 in longitudinal direction thereof, and where the tubular body 71 further exhibits at least two wings 73 cut out in circumferential direction thereof and slightly projected/inclined from the circumference of the tubular body 71, wherein the wings 73 have progressive spring properties, i.e. arranged to the tubular in a resilient manner. Accordingly, the wings 73 are arranged so that they can be pressed towards the central axis of the tubular body 71 when traveling through a hole, and will return to projected/inclined position when the retaining device 70 has passed through the hole. It is further preferably arranged a stop disc 74 between the spline shaft 31 and the drill bit 61 to prevent the retaining device 70 from moving in longitudinal direction.

Figure 3C:
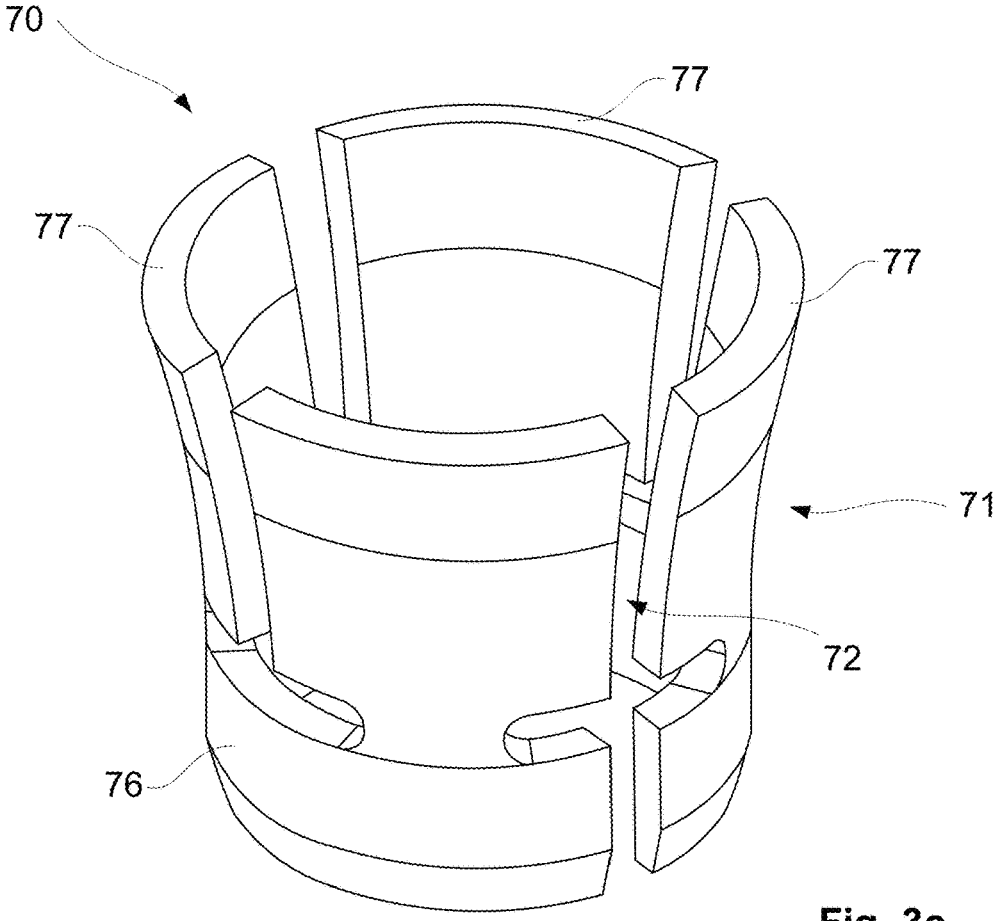

In FIG. 3*c* is shown a second embodiment of a retaining device 70 which is formed by a mainly tubular body 71 which exhibits an opening 72 in longitudinal direction thereof, and where the tubular body 71 further exhibits a mainly annular base 76 and from the annular base in longitudinal direction thereof exhibiting several elastic fingers 77 slightly inclined outwards in circumferential direction from the base 76, where the annular base 76 is arranged against the drill bit 61 and the fingers 77 are extending upwards from the drill bit 61. Accordingly, the fingers 77 are arranged so that they can be pressed towards the central axis of the annular base 76 when traveling through a hole, and will return to projected/inclined position when the retaining device 70 has passed through the hole.

The pretension assembly 50 is formed by at least one helical spring 51, and are arranged between the upward protruding flange 43 of tubular body 41 of the cutting assembly 40 and the adapter 20.

The spline shaft 31 is further provided with a threaded section 35 below the part provided with ridges 33 adapted for arrangement of a washer 36 and locking nut 37. The spline shaft 31 extends through the pretension assembly 50, through the spline bushing 34, where the ridges 33 of the spline shaft 31 is in engagement with corresponding recesses 38 of the spline bushing 34. In this way the pretension assembly 50 will be fixed between the adapter 20 and the tubular body 41 of the cutting assembly 40, and the spline shaft 31 will via the spline bushing 34 connect the cutting assembly 40 to the spline shaft 31.

Accordingly, by rotation of the adapter 20, the spline shaft 31 will rotate, the drilling assembly 60 will rotate and the cutting assembly 40 will rotate.

According to a further embodiment the downhole stuck object tool 10 further comprises a retaining assembly 100 arranged in upper part of the cutting assembly 40. The retaining assembly 100 is arranged for engagement with the spline shaft 31. According to a preferred embodiment the retaining assembly 100 comprises spring-based retaining elements 101 arranged in holes arranged in circumferential direction of the flange 43 of the tubular body 41. Further, the spline shaft 31 is preferably at lower end of the part provided with ridges 33 provided with a circumferential recess 102 arranged for accommodating the spring-based retaining elements 101. Accordingly, the spring-based elements 101 will, when a certain weight/pushing force is applied to the spline shaft 31, retract and allow the spline shaft 31 and thus the drilling assembly 60 to move in longitudinal direction of cutting assembly 40/downhole stuck object tool 10.

By the pretension assembly 50 arranged between the adapter 20 and the cutting assembly 40 the weight/pushing force applied to the adapter 20 by a downhole drive system can be used to control how much weight/pushing force the cutting assembly 40 and drilling assembly 60, respectively, exert on the stuck object. The optional retaining assembly 100 will further ensure that the drilling assembly 60 is not activated before the cutting assembly 40 has cut a guide slot in the stuck object and is in safe engagement with the stuck object.

Further, by the pretension assembly 50 and optional retaining assembly 100 one ensures that the cutting assembly 40 will always land on the stuck object first and will start cutting into the stuck object before the drilling assembly 60 starts to drill through the object. By this is achieved safe engagement between the downhole stuck object removal tool 10 and the stuck object, as well as will ensure proper centralization of the drilling assembly 60 in relation to the stuck object, regardless of the shape of the object.

The pretension assembly 50 further enables that one can use different weight/pushing force for the cutting assembly 40 and drilling assembly 60 if required or desired.

Reference is gain made to FIGS. 1*a-c* and 2. According to a further embodiment the tubular body 41, there are arranged through holes 47 at an upper part thereof, in a circumferential direction thereof. The holes 47 will allow fluid flow, as well as metal shavings/particles, to pass through the openings 47, in or out of the tubular body 41.

According to a further embodiment, there are arranged magnet assemblies 48, containing a mount 48*a* and at least one magnet 48*b*, e.g. neodym magnets, at upper end of the tubular body 41, preferably in a circumferential manner, and arranged between the mentioned holes 47 for collection of metal shavings/particles from drilling and cutting of a stuck object.

According to a further embodiment, the inner hole saw 46 is provided with through openings 49 in a circumferential direction thereof, at an area below the outer hole saw 45, to allow fluid flow, as well as metal shavings/particles to pass, into the tubular body 41.

According to a further embodiment, the outer 45 and inner 46 hole saw are provided with grooves 80 extending at exterior surface thereof, extending from lower end thereof to upper end thereof.

Figure 4:
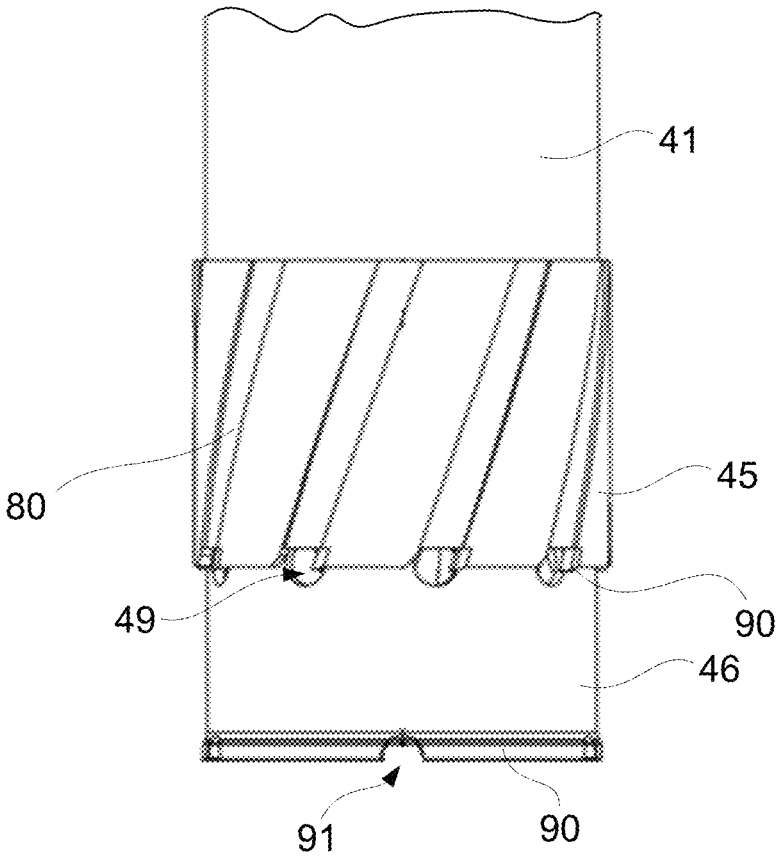
FIG. 4 shows a hole saw assembly portion of an alternative embodiment of the disclosed tool.

In an alternative embodiment, as shown in FIG. 4, only the outer hole saw 46 is provided with grooves 80 extending at exterior surface thereof, extending from lower end thereof to upper end thereof.

In a preferred embodiment the mentioned grooves 80 preferably extend in a curved path from the lower end to the upper end of the hole saw(s) 45/46. It is further preferable that the grooves 80 of the inner 46 and outer 45 hole saw correspond with each other. It is further preferable that the grooves 80 of the inner hole saw 46 and/or or outer hole saw 45 correspond/coincide with the above mentioned holes 49 in the inner hole saw 46.

Figure 2:
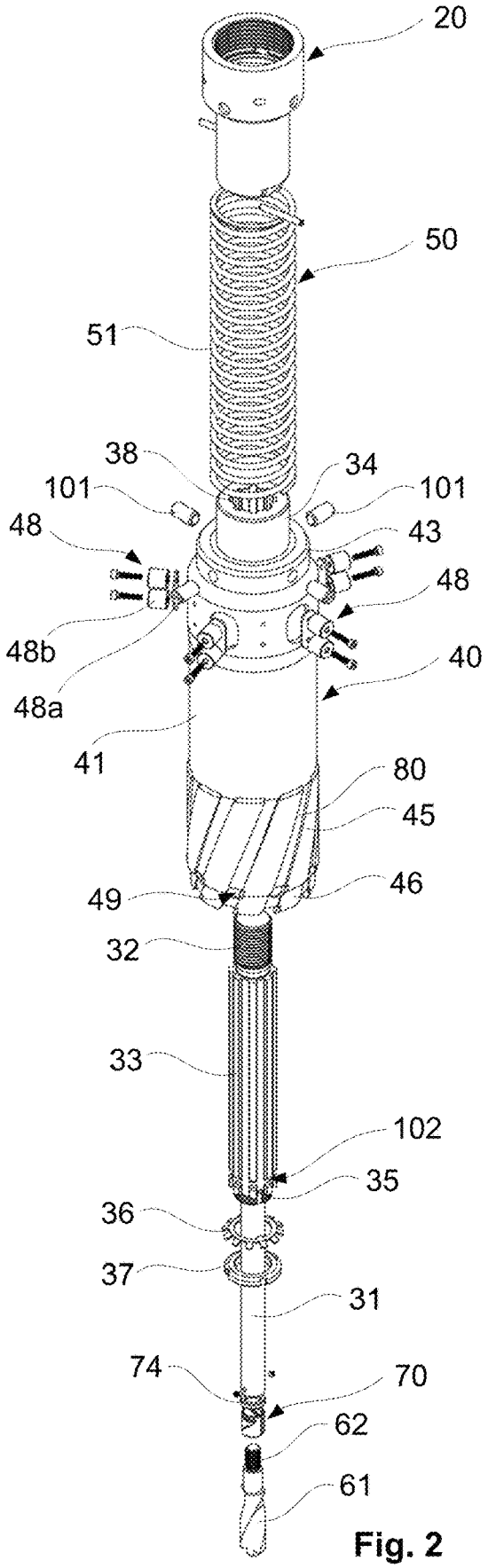
FIG. 2 is an exploded drawing of the downhole stuck object removal tool.

According to a further embodiment cutting edges of the inner 46 and/or outer hole 45 saws are provided with wolfram carbide cutting segments 90, polycrystalline diamond cutting segments 90 or Polycrystalline cubic boron nitride cutting segments 90. In the embodiment of FIGS. 1-3, the holes saws 45, 46 are provided with wolfram carbide cutting segments 90 or polycrystalline diamond cutting segments 90 resulting in that metal shavings are cut out of the stuck object, requiring grooves 80 exterior of both hole saws 45, 46 for transporting the metal shavings away from the cutting edges of the hole saws 45, 46.

In the embodiment shown in FIG. 4, the inner hole saw 46 is provided with polycrystalline diamond cutting segments 90 while the outer hole saw 45 is provided with wolfram carbide cutting segments 90. The use of Polycrystalline cubic boron nitride cutting segments 90 at the inner hole saw 46 will result in that metal particles are cut out of the stuck object and there is accordingly no need for grooves 80 exterior of the inner hole saw 46. When using Polycrystalline cubic boron nitride cutting segments 90 at the inner hole saw 46 it is preferably arranged openings 91 between the segments 90 to allow flow of fluid and metal particles to pass into the tubular body 41.

In both the shown embodiments the cutting segments 90 of the outer 45 and/or inner 46 hole saw can be arranged such that they exhibit a slightly larger exterior diameter than hole saws 45, 46, to allow metal shavings/particles/fluid to pass in the longitudinal direction of the hole saws 45, 46.

Further, as shown in FIGS. 1*b* and 1*c* the drill bit 61 is preferably a step drill bit. By using a step drill bit 61 one will achieve easier penetration/entering of a rounded or curved or concave or convex surface of a stuck object, as the drill bit 61 will not slide on the surface of the stuck object.

A typical application of the disclosed tool is to open a stuck ball valve in a casing, where one desire to drill/cut and remove the closed ball valve. For powering and controlling the downhole stuck object tool 10 e.g. a tractor with available downward push force can be used, and further capable of providing a rotational speed and torque required for operation of the cutting assembly 40 and drilling assembly 60. The downhole stuck object tool 10 is transported by the tractor downhole to the stuck ball valve. The cutting assembly 40 will then land on the upper half of the ball valve with the inner hole saw 46 and the drilling assembly 60 retracted in the cutting assembly 40 by the pretension in the pretension assembly 50 and optionally the retaining force of the retaining assembly 100.

The downhole stuck object tool 10 can then be rotated at a certain rotational speed and the tractor can push with a certain force on the adapter 20, not exceeding the pretension force of the pretension assembly 50 and/or retaining force of the retaining assembly 100, whereupon the cutting assembly 40 will start cutting into the upper half of the ball valve with the inner hole saw 46, with the drilling assembly 60 retracted in the cutting assembly 40, ensuring that the downhole stuck object tool 10 is in safe engagement with ball valve and ensuring that the drilling assembly 60 is centralized in relation to the ball valve. Accordingly, the inner hole saw 46 cuts out a guide slot on the upper half of the ball valve.

After the landing stage and initial cutting stage, the tractor pushes with a weight/force exceeding the pretension force of the pretention assembly 50 and optionally the retaining force of the retaining assembly 100, whereupon the drilling assembly 60 is moved from the retracted position to an advanced drilling position and drills through the upper half of the ball valve and the inner 45 and outer 46 saw cuts in the upper half of the ball valve.

Next the drilling assembly 60, after it has drilled through the upper half of the ball valve will land on the lower half of the ball valve and start drilling in the lower half of the ball valve, preferably before the cutting assembly 40 has cut through the upper half of the ball valve.

The drilling assembly 60 will next drill through the lower half of the ball valve, while the drilling assembly 40 cuts through the upper half of the ball valve and the inner hole saw 46 lands on the lower half of the ball valve and starts cutting through the lower half of the ball valve.

When the drilling assembly 60 has drilled through the lower half of the ball valve the retention device 70 will be activated/expands due to the inherent spring/pretension force in the wings 73/fingers 77 and retain the lower half of the ball valve. When also the cutting assembly 40 has cut through the lower half of the ball valve, the downhole drive system, i.e. the tractor, will experience a drop in moment, indicating that the ball valve has been removed. The detection of that the drilling assembly 60 and cutting assembly 40 have drilled/cut through the lower half of the ball valve can be achieved by providing the tractor with a moment sensor, which will sense this by a drop in moment/torque.

Monitoring the moment can also be used to lower the weight/pushing force after the drilling assembly 60 has drilled through the lower half of the ball valve. By lowering the weight/pushing forces at the last stage, which is cutting through the lower ball half with the cutting assembly 40, one will have better control of the cutting process. By lowering the weight/pushing force below the pretention force of the pretension assembly 50, this will also result in that the drilling assembly 60 will retract and secure safe engagement of the retention device 70 with the lower ball half.

Accordingly, by use of a moment sensor drop or increase in torque can be detected at different stages in the drilling/cutting process whereupon one can increase or decrease the weight/pushing force as well as rotational speed as desired or required. The weight/pushing force at the completion of the drilling/cutting process will also sometimes depend on the pressure of fluid behind the ball valve.

The downhole stuck object tool 10 can be now be retracted with the upper ball valve half secured and stabilized on the drilling assembly 60/spline shaft 31 in the cutting assembly 40/tubular body 41, and the lower ball valve half secured and stabilized on the drilling assembly 60/spline shaft 31 and the retaining device 70, as well as all metal shavings/particles collected in the tubular body 41 by the magnet assemblies 48, above the upper half of the ball valve and between the halves of the ball valve.

Accordingly, full control of the cutting and drilling is achieved and one run with no stops will complete the entire operation.

Further, the entire operation can be controlled by defined weight/pushing force on the drilling assembly 60, as well as rotation speed thereof.

A skilled person will understand that in situations where a pressurized fluid is located behind the valve to be opened appropriate means for pressurization are arranged in connection with the tractor/downhole stuck valve removal tool 10, to handle the pressure from the fluid.

The invention claimed is:

1. A downhole stuck object removal tool (10) for arrangement to a downhole drive system, comprising:

a longitudinally extending cutting assembly (40) having an axis, the cutting assembly having a tubular body (41) extending to a lower part adjacent a distal end of the cutting assembly (40), a hole saw assembly (44) arranged on said lower part and including an outer hole saw (45) and an inner hole saw (46);

a drilling assembly (60) coaxial with the cutting assembly (40)

and movable in a longitudinal direction in the cutting assembly (40), from a retracted position in the cutting assembly (40) to an advanced drilling position extending past the distal end of the cutting assembly (40); and a spline drive assembly (30) to which the cutting assembly (40) and the drilling assembly (60) are coupled for rotation, said spline drive assembly (30) including a retaining device (70) coupling the drilling assembly (60) to a lower end of the spline drive assembly (30), wherein the outer hole saw (45) has an exterior diameter adapted to an inner diameter of a casing, string, or borehole, and has an inner diameter corresponding to an inner diameter of the tubular body (41), the inner hole saw (46) has an outer diameter corresponding to the inner diameter of the outer hole saw (45) and is arranged at a lower part of the outer hole saw (45) and protrudes longitudinally from the outer hole saw (45).

2. The downhole stuck object removal tool (10) of claim 1, comprising a pretension assembly (50) arranged in connection with the drilling assembly (60), the pretension assembly (50) providing a retaining force or pretension force for the drilling assembly (60) in the longitudinal direction of the cutting assembly (40).

3. The downhole stuck object removal tool (10) of claim 1, comprising a spring-loaded retaining assembly (100) arranged in the cutting assembly (40) providing a retaining force for the drilling assembly (60) in the longitudinal direction of the cutting assembly (40), said retaining force holding said drilling assembly (60) in the retracted position until a predetermined force is applied to the spline drive assembly (30).

4. The downhole stuck object removal tool (10) of claim 1, wherein the cutting assembly (40) is coupled to the spline drive assembly (30) via a spline bushing (34).

5. The downhole stuck object removal tool (10) of claim 1, wherein the spline drive assembly (30) is configured for moving the drilling assembly (60) in the longitudinal direction relative to the cutting assembly (40).

6. The downhole stuck object removal tool (10) of claim 1, wherein the tubular body (41) includes through holes (47) circumferentially spaced from one another around an upper part thereof.

7. The downhole stuck object removal tool (10) according to claim 1, wherein the tubular body (41) includes a plurality of magnet assemblies (48) circumferentially spaced from one another at an upper part thereof.

8. The downhole stuck object removal tool (10) of claim 1, wherein the inner hole saw (46) is provided with holes (49) circumferentially spaced from one another, below the outer hole saw (45).

9. The downhole stuck object removal tool (10) of claim 1, wherein at least one of the outer hole saw (45) and inner hole saw (46) is provided with grooves (80) at an exterior surface thereof, extending from a lower end to an upper end thereof.

10. The downhole stuck object removal tool (10) of claim 8, wherein at least one of the outer hole saw (45) and inner hole saw (46) is provided with grooves (80) at an exterior surface thereof, extending from a lower end to an upper end thereof, and circumferentially align with the holes (49) in the inner hole saw (46).

11. The downhole stuck object removal tool (10) of claim 1, wherein the at least one of the outer hole saw (45) and inner hole saw (46) has a cutting surface (90) made from wolfram carbide, polycrystalline diamond or polycrystalline cubic boron nitride.

12. The downhole stuck object removal tool (10) of claim 1, comprising an adapter (20) for connection to the downhole drive system.

* * * * *